US007507325B2

(12) United States Patent
Gueret et al.

(10) Patent No.: US 7,507,325 B2
(45) Date of Patent: Mar. 24, 2009

(54) PROCESS FOR CONVERTING HEAVY PETROLEUM FRACTIONS FOR PRODUCING A CATALYTIC CRACKING FEEDSTOCK AND MIDDLE DISTILLATES WITH A LOW SULFUR CONTENT

(75) Inventors: Christophe Gueret, St. Romain en Gal (FR); Pierre Marion, Antony (FR); Cecile Plain, Saint Germain EN Laye (FR); Jerome Bonnardot, Le Chesnay (FR); Eric Benazzi, Chatou (FR); Olivier Martin, Saint Germain EN Laye (FR)

(73) Assignee: Institut Francais du Petrole, Rueil Malmaison Cedex (FR)

( * ) Notice: Subject to any disclaimer, the term of this patent is extended or adjusted under 35 U.S.C. 154(b) by 228 days.

(21) Appl. No.: 10/152,987

(22) Filed: May 23, 2002

(65) Prior Publication Data

US 2003/0089637 A1 May 15, 2003

Related U.S. Application Data

(60) Provisional application No. 60/357,640, filed on Feb. 20, 2002.

(30) Foreign Application Priority Data

Nov. 9, 2001 (FR) ..... 01 14531

(51) Int. Cl.
*C10G 45/04* (2006.01)
*C10G 47/02* (2006.01)

(52) U.S. Cl. ..... 208/89; 208/59; 208/58; 208/108; 208/209; 208/212

(58) Field of Classification Search ..... 208/58, 208/61, 97, 108
See application file for complete search history.

(56) References Cited

U.S. PATENT DOCUMENTS

| | | | | |
|---|---|---|---|---|
| 3,751,360 | A * | 8/1973 | Bernstein et al. | 208/61 |
| 4,859,309 | A * | 8/1989 | de Vries et al. | 208/61 |
| 5,026,472 | A * | 6/1991 | Hoehn et al. | 208/58 |
| 5,447,621 | A * | 9/1995 | Hunter | 208/58 |
| 6,444,116 | B1 * | 9/2002 | Galiasso et al. | 208/58 |
| 6,676,828 | B1 | 1/2004 | Galiasso et al. | |
| 6,787,025 | B2 * | 9/2004 | Mukherjee et al. | 208/89 |
| 6,793,804 | B1 | 9/2004 | Lindsay et al. | |

* cited by examiner

*Primary Examiner*—Tam M Nguyen

(57) ABSTRACT

The invention relates to a process and installation for treating heavy petroleum feedstocks for producing a gas oil fraction that has a sulfur content of less than 50 ppm and most often 10 ppm that includes the following stages: a) mild hydrocracking in a fixed catalyst bed, b) separation from hydrogen sulfide of a distillate fraction that includes a gas oil fraction and a heavier fraction than the gas oil, c) hydrotreatment (including desulfurization) of said distillate fraction, and d) separation of a gas oil fraction with less than 50 ppm of sulfur. Advantageously, the heavy fraction is sent into catalytic cracking. The process preferably operates with make-up hydrogen that is brought to stage c), and very advantageously all of the make-up hydrogen of the process in introduced in stage c).

19 Claims, 1 Drawing Sheet

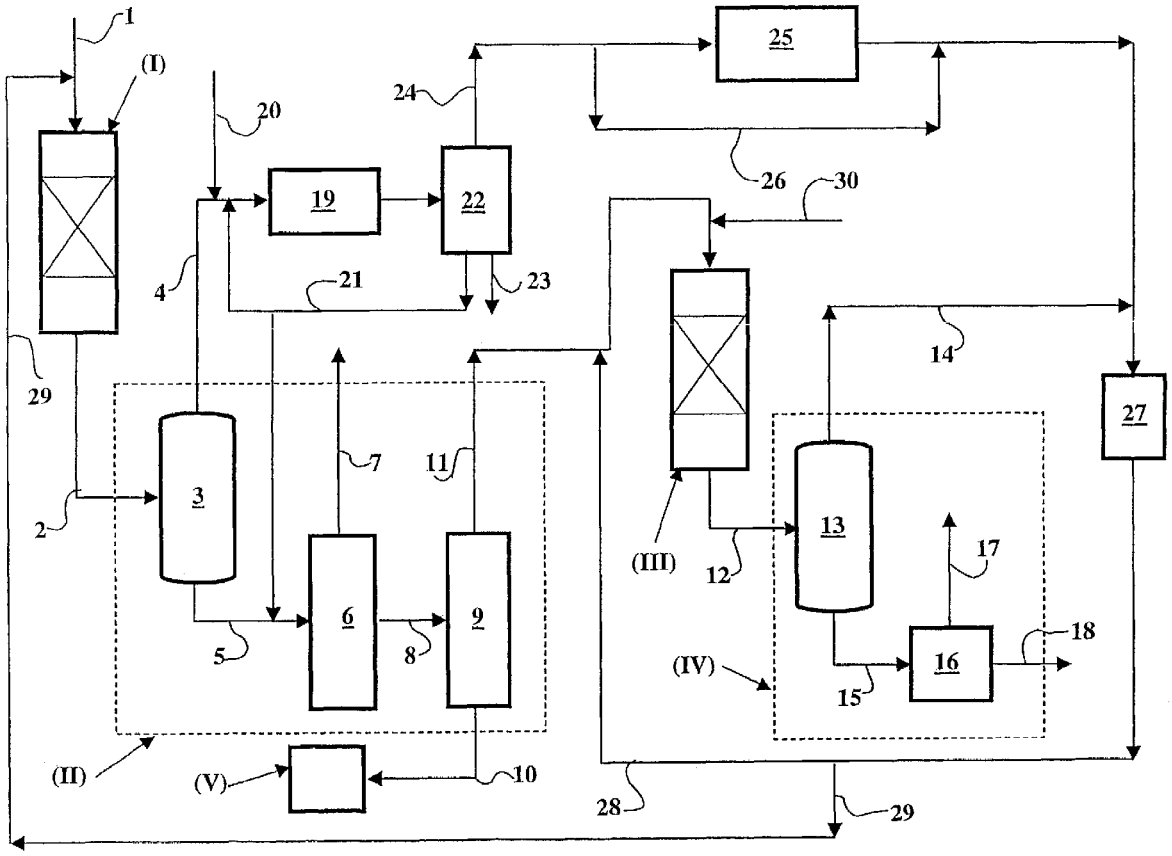
1
(I)
20
24
25
19
22
26
30
4
21
23
29
14
27
3
7
11
2
13
(III)
12
17
6
9
5
8
16
18
(IV)
15
(II)
(V)
10
28
29

PROCESS FOR CONVERTING HEAVY PETROLEUM FRACTIONS FOR PRODUCING A CATALYTIC CRACKING FEEDSTOCK AND MIDDLE DISTILLATES WITH A LOW SULFUR CONTENT

CROSS-REFERENCE TO RELATED APPLICATION

This application claims the priority of Provisional Application Ser. No. 60/357,640 and is related to Applicants' concurrently filed application entitled "Process For Converting Heavy Petroleum Fractions Including An Ebulliated Bed For Producing Middle Distillates With A Low Sulfur Content", based on French Application No. 01/14.594, filed Nov. 12, 2001.

This invention relates to a process and an installation for the treatment of heavy hydrocarbon feedstocks that contain sulfur-containing impurities. It relates to a process that makes it possible to convert at least in part such a hydrocarbon feedstock, for example a vacuum distillate that is obtained by direct distillation of a crude oil, into a gas oil that meets the 2005 sulfur specifications, i.e., that has less than 50 ppm of sulfur, and into a heavier product that can advantageously be used as a feedstock for catalytic cracking (such as the fluidized-bed catalytic cracking).

Until 2000, the sulfur content allowed in diesel fuel was 350 ppm. Drastically more restricting values are expected for 2005, however, since this maximum content will be reduced to 50 ppm.

The inventors therefore sought a process that makes it possible to achieve this goal. In providing such a process the goal was to a large extent exceeded since contents of less than 20 ppm and even 10 ppm were generally obtained.

More specifically, the invention relates to a process for treating petroleum feedstocks of which at least 80% by weight boils above 340° C. and which contains at least 0.05% by weight of sulfur for producing at least one gas oil fraction with a sulfur content of at most 50 ppm by weight, whereby said process comprises the following stages:

a) Mild hydrocracking in a fixed bed containing at least one catalyst at a temperature of 330-500° C., a pressure of at least 2 MPa and less than 12 MPa, an hourly space velocity of 0.1 $h^{-1}$ to 10 $h^{-1}$ and in the presence of 100-5000 Nm3 of hydrogen/m3 of feedstock, whereby the net conversion of products boiling below 360° C. is 10-50% by weight, b) Separation from the effluent of a gas that contains hydrogen, hydrogen sulfide formed in stage a) and a heavier fraction than the gas oil, c) Hydrotreatment, by contact with at least one catalyst, of at least one distillate fraction that is obtained in stage b) and that includes a gas oil fraction, at a temperature of 300-500° C., a pressure of 2-12 MPa, an hourly space velocity of 0.1-10 $h^{-1}$ and in the presence of 200-5000 Nm3 of hydrogen/m3 of feedstock, d) Separation of hydrogen, gases and at least one gas oil fraction with a sulfur content of less than 50 ppm by weight.

The treated feedstocks are heavy, i.e., 80% by weight boils above 340° C. Their initial boiling point is generally established at at least 340° C., often at at least 370° C. and even at least 400° C. Very advantageously, the process makes it possible to treat feedstocks that have a final boiling temperature of at least 450° C. and that can even go beyond 650° C.

The sulfur content is at least 0.05% by weight, often at least 1% and very often at least 2%, and even at least 2.5% by weight. Feedstocks with 3% sulfur or more are very suitable in this process.

The feedstocks that can be treated within the framework of this invention are vacuum distillates of direct distillation, vacuum distillates that are obtained from a conversion process such as, for example, those that are obtained from coking, a fixed-bed hydroconversion (such as those that are obtained from the HYVAHL® processes for treatment of heavy products developed by Institut Francais du Petrole) or processes for hydrotreatment of heavy products in a boiling bed (such as those that are obtained from H-OIL® processes) or else oils that are deasphalted with solvent (for example with propane, butane or pentane) that are obtained from deasphalting of direct distillation vacuum residue or residues that are obtained from HYVAHL® and H-OIL® processes. The feedstocks can also be formed by mixing these various fractions. They can also contain gas oil fractions and heavy gas oils that are obtained from catalytic cracking that have in general a distillation range of from about 150° C. to about 370° C. They can also contain aromatic extracts and paraffins that are obtained within the framework of the production of lubricating oils. According to this invention, the feedstocks that are treated are preferably vacuum distillates.

Stage a)—The feedstock as described above is treated in stage a) by mild hydrocracking.

The operation is usually carried out under an absolute pressure of 2 to 12 MPa, often 2 to 10 MPa and most often 4 to 9 MPa or 3 to 7 MPa at a temperature of about 300 to about 500° C. and often from about 350 to about 450° C. The hourly space velocity (VVH) and the partial pressure of hydrogen are selected based on characteristics of the product to be treated and the desired conversion. Most often, the VVH lies in a range of from about 0.1 $h^{-1}$ to 10 $h^{-1}$ and preferably about 0.2 $h^{-1}$ to about 5 $h^{-1}$. The total amount of hydrogen that is mixed with the feedstock ($H_2$ chemical consumption+recycling) and that therefore enters the zone in which stage a) is carried out is usually from about 100 to about 5000 normal cubic meters (Nm3) per cubic meter (m3) of liquid feedstock and most often from about 100 to about 2000 Nm3/m3, and in general it is at least 200 Nm3/m3 and preferably about 200 to about 1500 Nm3/3.

The net conversion of products that boil below 360° C. is generally from 10 to 50% by weight, advantageously between 15 and 45%.

The partial pressure of $H_2S$ at the outlet of stage a) is generally from 0.1-0.4 MPa, and it is advantageously maintained between 0.15-0.3 MPa and preferably between 0.15-0.25 MPa to improve the hydrodesulfurization.

It is possible to use a standard hydroconversion catalyst that comprises, on an amorphous support, at least one metal or metal compound that has a hydro-dehydrogenating function.

This catalyst can be a catalyst that comprises metals of group VIII in the catalyst, for example nickel and/or cobalt most often combined with at least one metal of group VIB, for example molybdenum and/or tungsten. It is possible, for example, to use a catalyst that comprises 0.5 to 10% by weight of nickel and preferably 1 to 5% by weight of nickel (expressed in nickel oxide NiO) and 1 to 30% by weight of molybdenum, preferably 5 to 20% by weight of molybdenum (expressed in molybdenum oxide MoO3) on an amorphous mineral support.

The total content of metal oxides of groups VI and VIII in the catalyst is often from about 5 to about 40% by weight and in general from about 7 to 30% by weight and advantageously the ratio by weight that is expressed in metal oxide between metal (or metals) of group VI to metal (or metals) of group VIII is in general from about 20 to about 1 and most often from about 10 to about 2.

The support will be selected, for example, from the group that is formed by alumina, silica, silica-aluminas, magnesia, clays and mixtures of at least two of these minerals. This support can also contain other compounds and, for example, oxides that are selected from the group that is formed by boron oxide, zirconia, titanium oxide, and phosphoric anhydride. Most often an alumina support, and, better, η-alumina or γ-alumina is used.

The catalyst can also contain an element such as phosphorus and/or boron. This element may have been introduced into the matrix or preferably have been deposited on the support. It is also possible to deposit the silicon on the support, alone or with phosphorus and/or boron. Preferred catalysts contain silicon that is deposited on a support (such as alumina) optionally with P and/or B that are also deposited and that also contain at least one metal of GVIII, Ni, Co and at least one metal of GVIB (Mo, W). The concentration of said element is usually less than about 20% by weight (theoretical oxide) and most often less than about 10%, and it is usually at least 0.001% by weight. The concentration of boron dioxide $B_2O_3$ is usually from about 0 to about 10% by weight.

Another catalyst comprises at least one metal of group VIII and at least one metal of group VIB and a silica-alumina.

Another type of catalyst that can be used is a catalyst that contains at least one matrix, at least one Y zeolite and at least one hydro-dehydrogenating metal. The matrices, metals, and additional elements described above can also be part of the composition of this catalyst.

Advantageous Y zeolites are described in patent application Ser. Nos. WO-00/71641, EP-911 077 as well as U.S. Pat. Nos. 4,738,940 and 4,738,941.

The mild hydrocracking (stage a)) is carried out with at least one fixed bed of at least one catalyst, and a hydrocracked effluent is produced.

Stage b) in which said hydrocracked effluent is subjected at least in part, and preferably completely, to one or more separations.

The object of this stage is to separate the gases from the liquid, and, in particular, to recover the hydrogen and the bulk of hydrogen sulfide $H_2S$ that is formed in stage a), then to obtain a liquid effluent that is free of dissolved $H_2S$.

During the separation of $H_2S$ from the liquid, a portion of naphtha can be separated. This portion is then stabilized ($H_2S$ removal).

The liquid effluent that is depleted in $H_2S$ and optionally treated with stabilized naphtha is distilled to obtain at least one distillate fraction that includes a gas oil fraction and at least one fraction that is heavier than the gas oil.

The distillate fraction can be a gas oil fraction or a gas oil fraction that is mixed with naphtha. It feeds stage c).

The liquid fraction that is heavier than the gas oil type fraction optionally can be sent into a catalytic cracking process in which it is advantageously treated under conditions that make it possible to produce a gas fraction, a gasoline fraction, a gas oil fraction and a fraction that is heavier than the gas oil fraction and often called slurry fraction by one skilled in the art.

In other cases, this liquid fraction that is heavier than the gas oil fraction can be used as an industrial fuel with a low sulfur content or as a thermal cracking feedstock.

When the naphtha is not sent into the mixture with the gas oil in stage c), it is distilled. The naphtha fraction that is obtained can advantageously be separated into heavy gasoline, which preferably will be a feedstock for a reforming process, and into light gasoline, which preferably will be subjected to a process for isomerization of paraffins.

At the output of stage b), the gas oil fraction most often has a sulfur content of between 100 and 500 ppm by weight, and the gasoline fraction most often has a sulfur content of at most 200 ppm by weight. The gas oil fraction therefore does not meet 2005 sulfur specifications. The other characteristics of the gas oil are also at a low level; for example, the cetane is on the order of 45 and the aromatic content is greater than 20% by weight.

In distillation, the conditions are generally selected such that the initial boiling point of the heavy fraction is from about 340° C. to about 400° C. and preferably from about 350° C. to about 380° C., and, for example, about 360° C.

For naphtha, the final boiling point is between about 120° C. and 180° C.

The gas oil lies between naphtha and the heavy fraction.

The boiling points ranges that are provided here are given only by way of example, since the user will select the boiling point range based on the quality and the quantity of the desired products, as is generally done.

Stage c) in which at least a portion, and preferably all, of the distillate fraction undergoes hydrotreatment so as to reduce the sulfur content below 50 ppm by weight, and most often below 10 ppm.

With said distillate fraction, it is possible to treat a fraction that is produced external to the process according to the invention, which normally cannot be incorporated directly into the gas oil pool. This hydrocarbon fraction can be selected from, for example, the group that is formed by the LCO (light cycle oils that are obtained from fluidized-bed catalytic cracking).

The operation is usually carried out under an absolute pressure of about 2 to 12 MPa, often from about 2 to 10 MPa and most often from about 4 to 9 MPa; it is also possible to work under 3 to 7 MPa. The temperature in this stage is usually from about 300 to about 500° C., often from about 300° C. to about 450° C. and very often from about 350 to about 420° C. This temperature is usually adjusted based on the desired level of hydrodesulfurization and/or saturation of aromatic compounds and should be compatible with the desired cycle duration. The hourly space velocity (VVH) and the partial hydrogen pressure are selected based on the characteristics of the product that is to be treated and the desired conversion.

The VVH most often lies in a range that goes from about 0.1 $h^{-1}$ to about 10 $h^{-1}$ and preferably 0.1 $h^{-1}$ to 5 $h^{-1}$ and advantageously from about 0.2 $h^{-1}$ to about 2 $h^{-1}$.

The total amount of hydrogen mixed with the feedstock is usually from about 200 to about 5000 normal cubic meters ($Nm^3$) per cubic meter ($m^3$) of liquid feedstock and most often from about 250 to 2000 $Nm^3/m^3$ and preferably from about 300 to 1500 $Nm^3/m^3$.

The operation is also usefully carried out with a reduced partial pressure of hydrogen sulfide that is compatible with the stability of the sulfide catalysts. In the preferred case of this invention, the partial pressure of the hydrogen sulfide is preferably less than 0.05 MPa, preferably 0.03 MPa, or better yet 0.01 MPa.

In the hydrodesulfurization zone, the ideal catalyst should have a strong hydrogenating power so as to carry out a deep refining of the products and to obtain a significant reduction of sulfur. In the preferred embodiment, the hydrotreatment zone operates at a relatively low temperature which tends to produce an intense hydrogenation therefore with a lowered aromatic compound content of the product an improvement in its cetane value and less coking. The scope of this invention would not be exceeded by using a single catalyst or several different catalysts in the hydrotreatment zone in a simultaneous manner or in a successive manner. Usually, this stage is carried out industrially in one or more reactors with one or more catalytic beds and with liquid downflow.

In the hydrotreatment zone, at least one fixed catalyst bed for hydrotreatment that comprises a hydro-dehydrogenating function and an amorphous support is used. A catalyst whose support is selected from, for example, the group that is formed by alumina, silica, silica-aluminas, magnesia, clays and mixtures of at least two of these minerals will preferably be used. This support can also contain other compounds and, for example, oxides that are selected from the group that is formed by boron oxide, zirconia, titanium oxide, and phosphoric anhydride. Most often an alumina support, and, better, η-alumina or γ-alumina is used.

The hydrogenating function is ensured by at least one metal of group VIII and/or group VIB.

In an advantageous case, the total content of metal oxides of groups VI and VIII is often from about 5 to about 40% by weight and in general from about 7 to 30% by weight, and the ratio by weight that is expressed by metal oxide between metal (metals) of group VI to metal (or metals) of group VIII is in general from about 20 to about 1 and most often from about 10 to about 2.

The ideal catalyst is to have a strong hydrogenating power so as to carry out a deep refining of the products and to obtain a significant reduction of sulfur. This catalyst can be a catalyst that comprises metals of group VIII, for example nickel and/or cobalt most often combined with at least one metal of group VIB, for example molybdenum and/or tungsten. A catalyst with an NiMo base will preferably be used. For the gas oils that are difficult to hydrotreat and for very high hydrodesulfurization rates, it is known to one skilled in the art that the desulfurization with a catalyst having an NiMo base is higher than that of a CoMo catalyst because the first shows a more significant hydrogenating function than the second. It is possible, for example, to use a catalyst that comprises 0.5 to 10% by weight of nickel and preferably 1 to 5% by weight of nickel (expressed in terms of nickel oxide NiO) and 1 to 30% by weight of molybdenum and preferably 5 to 20% by weight of molybdenum (expressed in terms of molybdenum oxide ($MoO_3$) on an amorphous mineral support.

The catalyst can also contain an element such as phosphorus and/or boron. This element may have been introduced into the matrix or have been deposited on the support. It is also possible to deposit the silicon on the support, alone or with phosphorus and/or boron.

The concentration of said element is usually less than about 20% by weight (theoretical oxide) and most often less than about 10% by weight, and it is usually at least 0.001% by weight. The concentration of boron trioxide $B_2O_3$ is usually from about 0 to about 10% by weight.

Preferred catalysts contain silicon that is deposited on a support (such as alumina), optionally with P and/or B also deposited and also containing at least one metal of GVIII (Ni, Co) and at least one metal of GVIB (W, Mo).

In the process according to the invention, the gasolines and the gas oils that are obtained from the conversion process, such as, for example, mild hydrocracking, are very refractory in the hydrotreatment if they are compared to gas oils that are obtained directly from the atmospheric distillation of crude oils.

To obtain very low sulfur contents, the critical point is the conversion of the most refractory radicals, particularly the dibenzothiophenes that are di- and trialkylated or more for which the access of the sulfur atom to the catalyst is limited by the alkyl groups. For this family of compounds, the path of the hydrogenation of an aromatic ring before desulfurization by rupture of the Csp3-S bond is faster than the direct desulfurization by rupture of the Csp2-S bond.

The conversion gas oils therefore require very strict operating conditions to reach future sulfur specifications. If it is desired to hydrotreat these conversion gas oils under operating conditions that make it possible to maintain a moderate investment with a reasonable cycle length of the hydrotreatment catalyst, an optimization of the integration of the equipment of the process is necessary.

We discovered that it is possible to obtain good quality gas oils while reducing investments costs by maximizing the partial pressure of hydrogen.

To do this, according to this particularly advantageous arrangement of the invention, make-up hydrogen is introduced into hydrotreatment stage c).

The amount of make-up hydrogen introduced in this stage c) is preferably larger than the chemical consumption of hydrogen that is necessary to obtain fixed performance levels under operating conditions that are fixed for this stage c).

This means that this amount is greater than that necessary for the desired hydrogenation level of the compounds that can be hydrogenated.

If a hydrogen material balance is carried out between the input corresponding to the hydrocarbon feedstock and the output corresponding to the liquid and gaseous effluents beyond separated hydrogen, the amount of make-up hydrogen is at least equal to the difference of the material balance; the difference that is found corresponds approximately to the chemical consumption of hydrogen.

A suitable means for measuring the hydrogen content in the feedstock or the liquid effluent is the RMN-$^1$H measurement. For the gaseous effluent, the chromatographic analysis is suitable.

In a preferred embodiment, all of the make-up hydrogen that is necessary to the process is introduced into stage c).

Accordingly, the amount that is provided will also take into account the chemical consumption of hydrogen in stage a) so as to provide the hydrogen that is necessary for the hydrogenation that is also desired in stage a).

Thus, in the process, the make-up hydrogen can therefore be introduced:

At stage a) only,

At stage c) only (advantageous and preferred arrangement),

At stages a and c) preferably with an amount in stage c) that corresponds to the criterion described above (advantageous arrangement).

Another consequence is that it is possible to optimize the addition of hydrogen in stage c) according to the refractory level of the gas oils to be treated.

This advantageous arrangement of the invention thus makes it possible to improve considerably the performance levels of the hydrotreatment catalyst and in particular the hydrodesulfurization for conditions of temperature and total pressure that are provided and that correspond to values that can be practiced industrially.

Actually, it makes it possible to maximize the partial hydrogen pressure, and therefore the performance level, in stage c), while maintaining an almost identical total pressure of stages a) and c) (and therefore their investment cost).

For feedstocks treated in stage a) that have a large amount of sulfur (for example that have at least 1% by weight of sulfur or at least 2%) and that produce refractory and sulfur-containing conversion gas oils, it has thus become possible to obtain good quality middle distillates in particular with a low sulfur content under conditions in particular of relatively low pressure and thus to limit the cost of necessary investments.

Stage d) of final separation on at least a portion, and preferably all, of the hydrotreated effluent that is obtained in stage c).

Excess hydrogen is separated from the effluent. It contains small amounts of hydrogen sulfide and usually does not require treatment.

The hydrogen sulfide is also separated from the liquid effluent and thus a gas oil is obtained with at most 50 ppm by weight of sulfur, and most often with less than 10 ppm by weight of sulfur. Naphtha is also obtained in general.

Treatment and Recycling of Hydrogen

The gas that contains hydrogen that was separated in stage b) is, if necessary, treated at least in part to reduce its $H_2S$ content (preferably by scrubbing with at least one amine) before recycling it in stage a) and optionally in stage c).

The recycle gas preferably contains an amount of H2S that is higher than 0 mol % and up to 1 mol %. Advantageously, this amount is at least 15 ppm, preferably at least 0.1 mol %, and even at least 0.2 mol %.

Thus, for example, at least a portion of the gaseous fraction can be sent into an amine scrubbing section where $H_2S$ is completely removed; the other portion can bypass the amine scrubbing section and be sent directly to recycling after compression.

The presence of $H_2S$ is useful for keeping the catalysts in the sulfurated state in stages a) and c), but excess $H_2S$ could reduce the hydrodesulfurization.

The hydrogen that is separated in stage d) is added to the optionally purified hydrogen that is obtained from stage b). The mixture is re-compressed and then recycled to stage a) and optionally to stage c).

Actually, in the case where make-up hydrogen is introduced into stage c), the recycling to stage c) may not be necessary, in particular when all of the make-up hydrogen is introduced in stage c).

It is advantageously possible to introduce the recycling hydrogen with the feedstock that enters stage a) and/or in quench form between the catalyst beds.

The gas oil that is obtained has a sulfur content of less than 50 ppm by weight, generally less than 20 ppm, and most often less than 10 pm.

Furthermore, the cetane is improved by 1 to 12 points, generally from 1 to 7, or else 1 to 5 points relative to the gas oil that goes into hydrotreatment.

Its total amount of aromatic compounds is also reduced by at least 10%, and the reduction can go even up to 90%.

The amount of polyaromatic compounds in the final gas oil is at most 11% by weight.

Installation

The invention also relates to an installation for treatment of petroleum feedstocks of which at least 80% by weight boils above 340° C. and which contains at least 0.05% of sulfur comprising:

a) A mild hydrocracking zone (I) that contains at least one fixed bed of hydrocracking catalyst and provided with a pipe (1) for introducing the feedstock to be treated, a pipe (2) for the output of the hydrocracked effluent, and a pipe (29) for the introduction of the hydrogen, b) a zone (II) for separation including at least one separator (3) (6) for separating the hydrogen-rich gas via pipe (4), for separating the hydrogen sulfide in pipe (7) and obtaining a liquid fraction in pipe (8), and also including a distillation column (9) for separating at least one distillate fraction that includes a gas oil fraction in pipe (11) and a heavy fraction in pipe (10), c) a hydrotreatment zone (III) that contains at least one fixed bed of hydrotreatment catalyst for treating a gas oil fraction that is obtained at the end of stage b), provided with a pipe for introducing hydrogen and a pipe (12) for the output of hydrotreated effluent, d) a separation zone (IV) that includes at least one separator (13) (16) for separating hydrogen via pipe (14), for separating the hydrogen sulfide in pipe (17) and for separating a gas oil that has a sulfur content of less than 50 ppm via pipe (18).

BRIEF DESCRIPTION OF THE DRAWING

To facilitate a better understanding of the installation as well as the process, FIG. 1 illustrates a preferred embodiment.

The feedstock that is to be treated (as defined above) enters via a pipe (1) into a mild hydrocracking zone (I) that contains at least one fixed bed of hydrocracking catalyst. The hydrocracked effluent that is obtained in pipe (2) is sent into separation zone (II).

The hydrocracked effluent first passes into a separator (3) that separates, on the one hand, a gas that contains hydrogen (gaseous phase) into pipe (4) and, on the other hand, a liquid effluent into pipe (5). It is possible to use a hot separator that is followed by a cold separator (preferred) or a cold separator only.

The liquid effluent is sent into a separator (6), which is preferably a vapor stripper, to separate the hydrogen sulfide from the hydrocarbon effluent. In the same step, at least a portion of the naphtha fraction can be separated with the hydrogen sulfide. The hydrogen sulfide with said naphtha exits via pipe (7) while the hydrocarbon effluent is obtained in pipe (8).

The hydrocarbon effluent then passes into a distillation column (9), and at least one distillate fraction that includes a gas oil fraction is withdrawn via pipe (11) and a heavier fraction than the gas oil is withdrawn via pipe (10).

In general, the naphtha that is separated at separator (6) is stabilized ($H_2S$ is eliminated). In an advantageous arrangement, the stabilized naphtha is injected into the effluent that enters column (9).

At column (9), a naphtha fraction can be separated and withdrawn via an additional pipe that is not shown in FIG. 1.

According to FIG. 1, column (9) separates a gas oil fraction that is mixed with naphtha into pipe (11). The fraction in pipe (10) is advantageously sent into catalytic cracking zone (V).

The naphtha that is obtained separately, optionally treated with naphtha that is separated in zone (IV), is advantageously separated into heavy and light gasolines, whereby the heavy gasoline is sent into a reforming zone, and the light gasoline is sent into a zone where the isomerization of paraffins is carried out.

In FIG. 1, the area circumscribed by dotted lines is separation zone (II) that is formed by separators (3) (6) and column (9).

The distillate fraction is then sent (alone or optionally treated with a naphtha fraction and/or gas oil fraction that is external to the process) into a hydrotreatment zone (III) that is provided with at least one fixed bed of hydrotreatment catalyst.

The hydrotreated effluent that is obtained exits via pipe (12) to be sent into separation zone (IV) that is circumscribed by dotted lines in FIG. 1.

Separation zone (IV) comprises a separator (13), preferably a cooled separator, where a gaseous phase that exits via pipe (14) and a liquid phase that exits via pipe (15) are separated.

The liquid phase is sent into a separator (16), preferably a stripper, to remove the hydrogen sulfide that exits into pipe (17), most often mixed with naphtha. A gas oil fraction is drawn off via pipe (18); a fraction that is in compliance with the sulfur specifications i.e., that has less than 50 ppm by weight of sulfur, is generally less than 10 ppm. The $H_2S$-naphtha mixture is then optionally treated to recover the purified naphtha fraction.

The process and the installation according to the invention also advantageously comprise a hydrogen recycling loop for two zones (I) and (II). Thus, the gas that contains hydrogen (gaseous phase in pipe (4) separated in zone (II)) is treated to reduce its sulfur content and optionally to eliminate the hydrocarbon compounds that have been able to pass during the separation.

Advantageously and according to FIG. 1, the gaseous phase of pipe (4) is sent into a cooling tower (19) after having been washed by the water that is injected via pipe (20) and partly condensed by a hydrocarbon fraction that is sent via line (21). The cooling tower effluent is sent into a separation zone (22) where the water that is drawn off via pipe (23), a hydrocarbon fraction that is drawn off via pipe (21) and a gaseous phase that is drawn off via pipe (24) are separated.

A portion of the hydrocarbon fraction of pipe (21) is sent into separation zone (II) and advantageously into pipe (5).

A particular embodiment for separating the entrained hydrocarbon compounds will now be described; however, any other method that is known to one skilled in the art is suitable.

The gaseous phase that is obtained in pipe (24) from which hydrocarbon compounds have been removed is, if necessary, sent into a treatment unit (25) for reducing the sulfur content.

Advantageously, this is a treatment with at least one amine.

In some cases, it is sufficient that only a portion of the gaseous phase be treated. In other cases, the entire gaseous phase should be treated, which is what is illustrated in FIG. 1, where a portion of the gaseous phase in pipe (26) does not pass into unit (25).

The gas that contains hydrogen that is thus optionally purified is then re-compressed in compressor (27).

The hydrogen that is separated in pipe (14) is preferably added before compression.

The compressed mixture is then recycled in part to hydrotreatment zone (III) (stage c) and in part to mild hydrocracking zone (I) (stage a) by pipes (28) and (29) respectively.

FIG. 1 shows that the recycling hydrogen is introduced at the inlet of the reaction zones with the liquid feedstock. It is also possible to introduce a portion of the hydrogen between the catalytic beds so as to control the initial temperature of the bed ("quench").

In the preferred embodiment of FIG. 1, all of the make-up hydrogen is introduced via pipe (30) at zone (II). In this embodiment, there is no pipe that provides make-up hydrogen at zone (I).

In another embodiment, it is possible to provide a pipe that brings the make-up hydrogen into zone (I).

An advantageous embodiment comprises, for the make-up hydrogen, a pipe at zone (I) and a pipe at zone (II).

As FIG. 1 depicts, a preferred method for bringing hydrogen into zone (III) consists in providing a pipe for recycling and a pipe for the addition.

The invention that is thus described offers numerous advantages. In addition to those already described, in the preferred embodiment where the pressures are identical for stages a) and c) because of the unique gas recirculation system, it is possible to use only a single recycling compressor for the two reaction zones, thus reducing the investment cost. Likewise, when the invention operates at moderate pressures, the investment costs are reduced. Furthermore, a very good quality feedstock for catalytic cracking (low contents of sulfur and nitrogen, moderate enrichment of hydrogen) is produced.

Without further elaboration, it is believed that one skilled in the art can, using the preceding description, utilize the present invention to its fullest extent. The following preferred specific embodiments are, therefore, to be construed as merely illustrative, and not limitative of the remainder of the disclosure in any way whatsoever.

In the foregoing and in the following examples, all temperatures are set forth uncorrected in degrees Celsius; and, unless otherwise indicated, all parts and percentages are by weight.

EXAMPLES

These examples were obtained in a pilot unit that differs from an industrial unit by virtue of the fact that the fluids are in up-flow mode in the pilot unit. It was further shown that this method of operation in a pilot unit provides results that are equivalent to those of an industrial unit that operates in trickle-bed mode.

Example 1

Addition of H2 at the MHDC Hydrocracking Inlet and at the HDT Inlet

The feedstock is a vacuum distillate that contains 3% by weight of sulfur. In the hydrocracking zone, about 35% of the 360° C.+ fraction is converted to compounds boiling below 360° C. After separation, a gas oil fraction is obtained that contains 250 ppm by weight of sulfur. This gas oil fraction is hydrotreated in a dedicated reactor.

The process is operated according to the flowsheet of FIG. 1 except for the fact that the addition of H2 is dedicated to each unit for hydrocracking and hydrotreatment. The recycling of the hydrogen-rich gas is common to two units with an amine scrubbing of the gas separated in stage b).

The purity of hydrogen of the recycling gas is 77.1 mol %. The partial pressure of hydrogen is 56.1 bar at the outlet of the hydrocracking section and 54.0 bar at the outlet of the hydrotreatment section. The operating conditions that are used for obtaining a gas oil fraction that has about 14 ppm of sulfur are:

| |
|---|
| Partial hydrogen pressure (PpH2) = 54 bar |
| Volumetric flow rate (VVH) = 0.62 |
| Reaction temperature (WABT) = 350° C. |

Example 2

Addition of H2 Only at the HDT Inlet Corresponding to the Total Consumption of H2 of the MHDC+HDT section With the same feedstock, the same hydrocracking operating conditions, the same treatment of hydrogen gas, the hydrogen purity of the recycling gas is 78.8 mol %. The partial hydrogen pressure is then 56.3 bar at the outlet of the hydrocracking section and 66.2 bar at the outlet of the hydrotreatment section for a total pressure at the intake of the recycling compressor that is increased by 2.5 bar. The operating conditions that are used for obtaining a gas oil fraction that has less than 10 ppm of sulfur are:

| |
|---|
| Partial hydrogen pressure (PpH2) = 66 bar |
| Volumetric flow rate (VVH) = 0.62 |
| Reaction temperature (WABT) = 350° C. |

This shows that the injection of the total addition of hydrogen in the HDT reactor as described in the preferred embodiment of this invention makes it possible to increase significantly the partial hydrogen pressure that is favorable for a very high desulfurization. This aspect of this invention therefore makes it possible either to operate with a higher feedstock flow rate in the hydrotreatment section as shown in this example or to work with a lower temperature that is favorable for a longer service life of the catalyst, or to obtain a more significant desulfurization while preserving the flow rate and the temperature of Example 1.

The preceding examples can be repeated with similar success by substituting the generically or specifically described reactants and/or operating conditions of this invention for those used in the preceding examples. Also, the preceding specific embodiments are to be construed as merely illustrative, and not limitative of the remainder of the disclosure in any way whatsoever.

The entire disclosure of all application, patents and publications, cited above and below, and of corresponding French Application No. 01/14.531, are hereby incorporated by reference.

From the foregoing description, one skilled in the art can easily ascertain the essential characteristics of this invention, and without departing from the spirit and scope thereof, can make various changes and modifications of the invention to adapt it to various usages and conditions.

The invention claimed is:

1. A process for treating a petroleum feedstock for producing at least one gas oil fraction with a sulfur content of at most 50 ppm by weight, wherein at least 80% by weight of the feedstock boils above 340° C. and the feedstock contains at least 0.05% by weight of sulfur, the process comprising:

a) mild hydrocracking in a fixed bed of at least one catalyst at a temperature of 330-500° C., a pressure of at least 2 MPa and less than 12 MPa, an hourly space velocity of 0.1 h-1 to 10 h-1 and in the presence of 100-5000 Nm3 of hydrogen/m3 of feedstock, wherein the net conversion of products boiling below 360° C. is 10-50% by weight, b) separating from the effluent of (a) a gas that contains hydrogen, hydrogen sulfide formed in a), a gas-oil containing distillate fraction and a heavier fraction than the gas oil, c) hydrotreating, by contact with at least one catalyst, of said at least one gas-oil containing distillate fraction that is obtained in b) at a temperature of 300-500° C., a pressure of 2-12 MPa, an hourly space velocity of 0.1-10 h-1 and in the presence of 200-5000 Nm3 of hydrogen/m3 of feedstock, and d) separating from the effluent of (c), in a zone different from (b), hydrogen, gases and at least one gas oil fraction with a sulfur content of less than 50 ppm by weight, wherein all of the make-up hydrogen that is necessary to the process is introduced in c).

2. A process according to claim 1, wherein the amount of make-up hydrogen that is introduced in c) is greater than the chemical consumption of hydrogen that is necessary for obtaining the performance levels that are fixed under the operating conditions that are fixed for c).

3. A process according to claim 1, wherein the heavier fraction is sent to a catalytic cracking process.

4. A process according to claim 1, wherein at the outlet of a) the resultant fluid has a partial pressure of H2S of 0.1-0.4 MPa, and at the outlet of c), less than 0.05 MPa.

5. A process according to claim 1, wherein in b), naphtha is also separated, and a gas oil fraction passes into c).

6. A process according to claim 1, wherein a gas oil fraction that is mixed with naphtha passes into c).

7. A process according to claim 1, wherein at least a portion of the gas that contains hydrogen and that is separated in b) is treated to reduce its hydrogen sulfide content and then is recycled to a), wherein the recycled gas contains at most 1 mol % of hydrogen sulfide.

8. A process according to claim 7, wherein the treatment is a washing with at least one amine.

9. A process according to claim 7, wherein the recycled gas also contains the hydrogen that is separated in d).

10. A process according to claim 7, wherein the hydrogen is also recycled to c).

11. A process according to claim 1, wherein the fractions that are separated in b) and d) are separated into heavy and light gasolines, the heavy gasoline is sent to a reforming unit, and the light gasoline is sent to a unit for the isomerization of paraffins.

12. A process according to claim 1, wherein the mild hydrocracking in a) and the hydrotreating in c) are conducted at substantially the same pressure.

13. A process according to claim 1, wherein the mild hydrocracking in a) and the hydrotreating in c) are conducted at identical pressure.

14. A process according to claim 1, wherein a whole naptha cut obtained in b) is sent to c).

15. A process according to claim 1, wherein the gas oil fraction, optionally containing naphtha, is obtained from the top of a column in b).

16. A process according to claim 1, wherein the gas oil fraction in (c) is produced externally to the process.

17. A process according to claim 16, wherein the gas oil fraction is light cycle oils obtained from fluidized bed catalytic cracking.

18. A process for treating a petroleum feedstock for producing at least one gas oil fraction with a sulfur content of at most 10 ppm by weight, wherein at least 80% by weight of the feedstock boils above 340° C. and the feedstock contains at least 0.05% by weight of sulfur, the process comprising:

a) mild hydrocracking in a fixed bed of at least one catalyst at a temperature of 330-500° C., a pressure of at least 2 MPa and less than 12 MPa, an hourly space velocity of 0.1 h-1 to 10 h-1 and in the presence of 100-5000 Nm3 of hydrogen/m3 of feedstock, wherein the net conversion of products boiling below 360° C. is 10-50% by weight, b) separating from the effluent of (a) a gas that contains hydrogen, hydrogen sulfide formed in a), a gas-oil containing distillate fraction and a heavier fraction than the gas oil, c) hydrotreating, by contact with at least one catalyst, of said at least one gas-oil containing distillate fraction that is obtained in b) at a temperature of 300-500° C., a pressure of 2-12 MPa, an hourly space velocity of 0.1-10 h-1 and in the presence of 200-5000 Nm3 of hydrogen/m3 of feedstock, and d) separating from the effluent of (c), in a zone different from (b), hydrogen, gases and at least one gas oil fraction with a sulfur content of less than 50 10 ppm by weight, wherein all of the make-up hydrogen that is necessary to the process is introduced in c).

19. A process for treating a petroleum feedstock for producing at least one gas oil fraction with a sulfur content of less than 10 ppm by weight, wherein at least 80% by weight of the feedstock boils above 340° C. and the feedstock contains at least 0.05% by weight of sulfur, the process comprising:

a) mild hydrocracking in a fixed bed of at least one catalyst at a temperature of 330-500° C., a pressure of at least 2 MPa and less than 12 MPa, an hourly space velocity of 0.1 h-1 to 10 h-1 and in the presence of 100-5000Nm3 of hydrogen/m3 of feedstock, wherein the net conversion of products boiling below 360° C. is 10-50% by weight, b) separating from the effluent of (a) a gas that contains hydrogen, hydrogen sulfide formed in a), a gas-oil containing distillate and a heavier fraction than the gas oil, c) hydrotreating, by contact with at least one catalyst, of said at least one gas-oil containing distillate fraction that is obtained in b) at a temperature of 300-500° C., a pressure of 2-12 MPa, an hourly space velocity of 0.1-10 h-1 and in the presence of 200-5000 Nm3 of hydrogen/m3 of feedstock, and d) separating from the effluent of (c), in a zone different from (b), hydrogen, gases and at least one gas oil fraction with a sulfur content of less than 50 10 ppm by weight, wherein all of the make-up hydrogen that is necessary to the process is introduced in c).

* * * * *

UNITED STATES PATENT AND TRADEMARK OFFICE

CERTIFICATE OF CORRECTION

PATENT NO. : 7,507,325 B2
APPLICATION NO. : 10/152987
DATED : March 24, 2009
INVENTOR(S) : Christophe Gueret et al.

It is certified that error appears in the above-identified patent and that said Letters Patent is hereby corrected as shown below:

Column 13, line 9 reads “with a sulfur content of less than 50 10 ppm by weight,” should read -- with a sulfur content of less than 10 ppm by weight, --

Column 14, line 15 reads “with a sulfur content of less than 50 10 ppm by weight,” should read -- with a sulfur content of less than 10 ppm by weight, --

Signed and Sealed this

Fourth Day of August, 2009

JOHN DOLL
*Acting Director of the United States Patent and Trademark Office*